United States Patent [19]

Warren

[11] 4,068,426

[45] Jan. 17, 1978

[54] ANCHORING APPARATUS

[76] Inventor: Harley K. Warren, 9108 Fifth Ave. South, Bloomington, Minn. 55420

[21] Appl. No.: 682,599

[22] Filed: May 3, 1976

[51] Int. Cl.[2] ..... E04D 1/34

[52] U.S. Cl. ..... 52/149; 52/23; 52/741; 52/DIG. 11; 105/477; 105/478; 254/51; 254/164

[58] Field of Search ..... 52/23, DIG. 11, 741, 52/148, 149; 105/464–486; 254/51, 52, 79, 161, 164, 186 HC; 248/354 S, 354 R, 354 C, 500, 503, 505

[56] References Cited

U.S. PATENT DOCUMENTS

| | | | |
|---|---|---|---|
| 1,324,575 | 12/1919 | Wright | 254/52 |
| 2,881,636 | 4/1959 | Palmleaf | 254/79 |
| 3,099,055 | 7/1963 | Huber | 254/51 |
| 3,848,367 | 11/1974 | Barnes | 52/23 |
| 3,881,694 | 5/1975 | Gardner | 52/DIG. 11 |
| 3,894,365 | 7/1975 | Abbott | 52/23 |

*Primary Examiner*—John E. Murtagh
*Attorney, Agent, or Firm*—Merchant, Gould, Smith, Edell, Welter & Schmidt

[57] ABSTRACT

An interconnection method and apparatus particularly useful for anchoring structures such as trailers in position, in which anchor plates having upstanding tongues with stepped clamps at their upper ends are secured to the ground beneath the structure. Anchor straps are secured to the structure in line with the tongues. A winch is releasably secured to any tongue below the clamp, and includes a drum with means securing an end of the anchor strap thereto after it passes through the clamp. By winching, clamping, releasing, and moving the winch to repeat the process, the desired securement of the structure is accomplished.

7 Claims, 6 Drawing Figures

ANCHORING APPARATUS

BACKGROUND OF THE INVENTION

This invention relates to the general field of arrangements for interconnecting relatively large bodies against relative motion, and is particularly intended for use in anchoring mobile homes to foundations. There is an increasing tendency to the purchase and use of mobile homes at fixed locations, and villages of mobile homes are rather common. In such communities, each structure has its own concrete slab, and usually a low substructure is provided to prevent the flow of wind under the structure. For this use it is very desirable that no significant relative movement take place between the mobile home and its substructure, as a result of wind, vibration, or other causes, and it is common to provide with the mobile home special metal straps located under the skin of the structure and passing over it from side to side, projecting at the bottom for use in anchoring the structure in the intended position. However, there has been no satisfactory way of tightening them sufficiently.

SUMMARY OF THE INVENTION

My invention comprises a procedure and apparatus for anchoring mobile homes in positions conveniently, quickly, and inexpensively. An anchor plate is secured to the slab on which the structure is to rest at each location where the end of a strap is available. The plates have upstanding tongues terminating in stepped clamps, and a winch is removably secured to any of the tongues. The strap is passed through the clamp and secured to the winch drum, so that operation of the winch tightens the strap. After it is clamped at the first clamp step, the winch can be released and removed, and the strap may then be folded back upon itself and secured at the second clamp step. By this means, a rapid, convenient, and inexpensive connection of the structure to the slab is accomplished. The same principle can, of course, be used to secure a first body to a second body not the earth.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

DESCRIPTION OF THE PREFERRED EMBODIMENT

Figure 1:
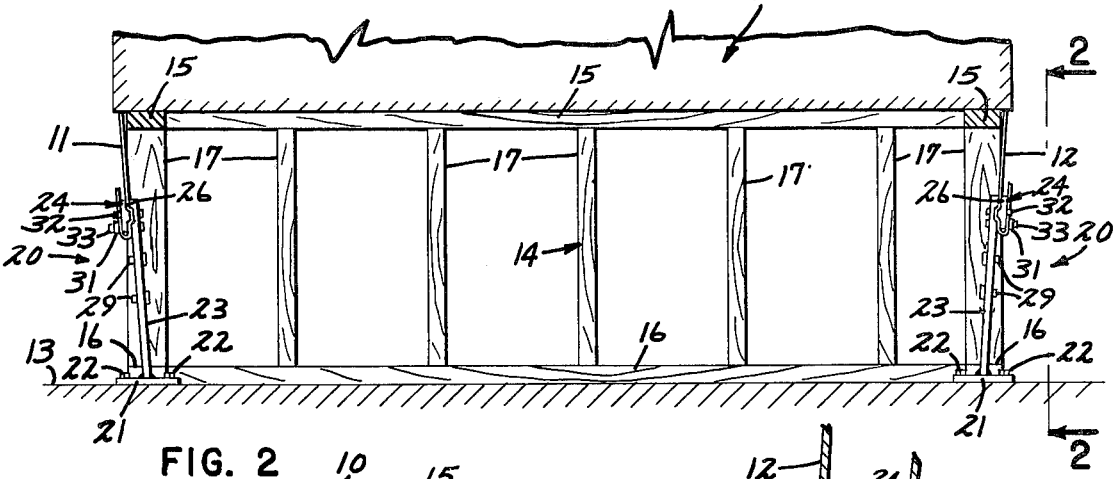
FIG. 1 is a view partly in section and partly schematic showing a mobile home secured to a substructure using my invention.
Figure 2:
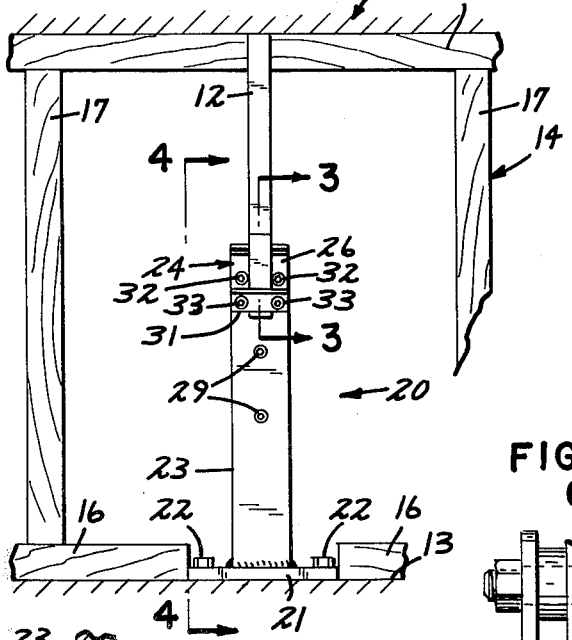
FIG. 2 is a fragmentary view from the line 2—2 of FIG. 1.

My invention is illustrated in its principal intended application, that of securing a mobile home in position. The mobile home is suggested at 10, and a metal strap which passes over the structure under its outer skin is shown to have depending end portions 11 and 12. The concrete mounting slab is shown at 13, and a timber substructure is indicated by the general reference numeral 14: it includes headers 15, sills 16, and studs 17 to which a suitable ornamental surface, not shown, may be secured. The running gear of the mobile home does not appear in the drawing.

Anchoring means 20 for the structure include anchor plates 21 secured to the slab by fasteners 22 and having upstanding tongues 23 with stepped clamps 24 at their upper ends. For convenience, tongues 23 are not perpendicular to plates 21, but are angulated at about 86° outward therefrom.

Figure 3:
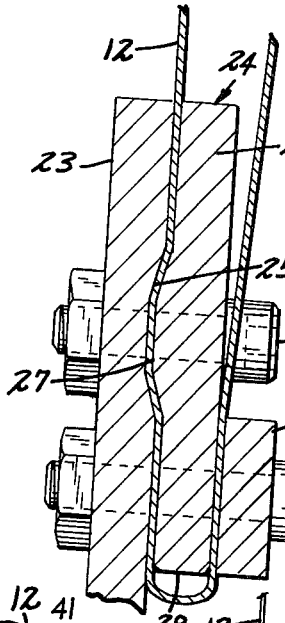
FIG. 3 is a sectional view along the line 3—3 of FIG. 2.
Figure 5:
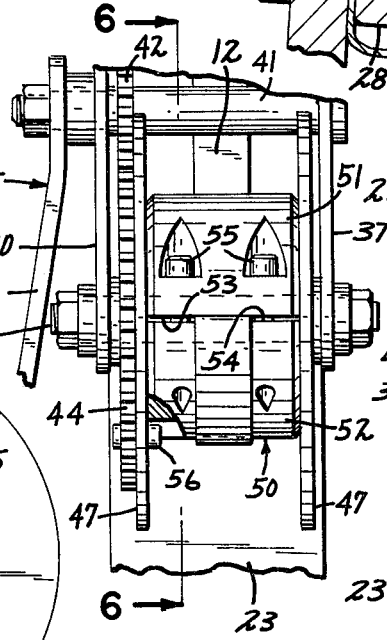
FIG. 5 is a fragmentary view from the line 5—5 of FIG. 4.
Figure 4:
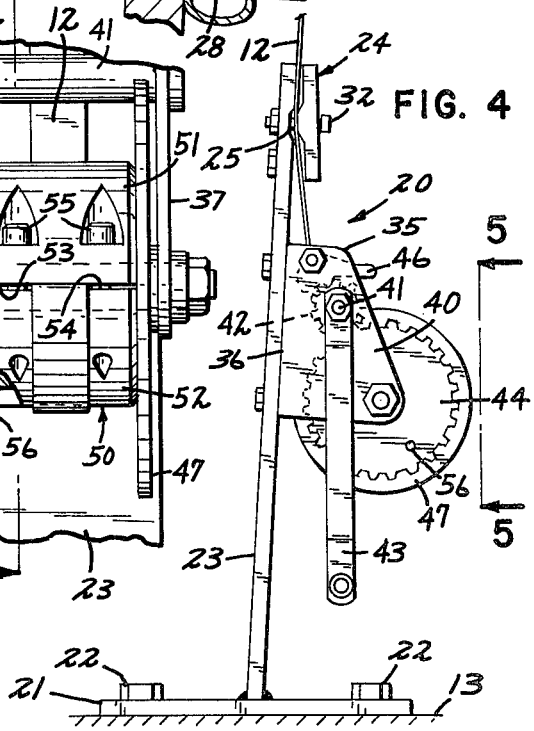
FIG. 4 is a fragmentary view, seen from the line 4—4 of FIG. 2, of my apparatus being used.
Figure 6:
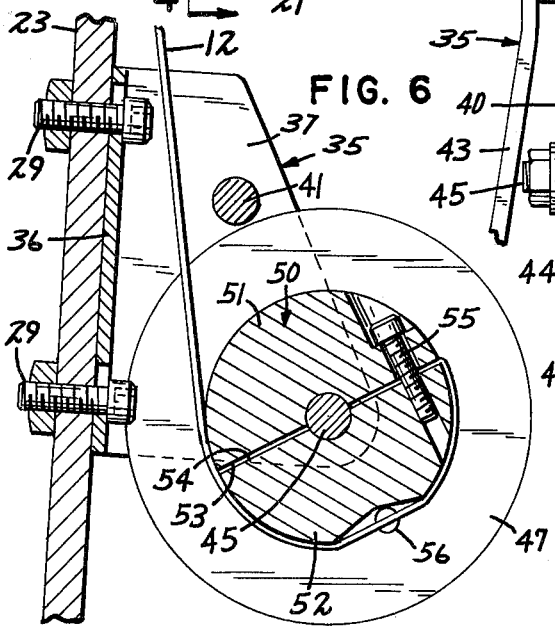
FIG. 6 is a fragmentary sectional view along the line 6—6 of FIG. 5 the figures are not all to the same scale.

As best shown in FIG. 3, each stepped clamp 24 comprises a shallow, generally arcuate transverse groove 25 near the end of a tongue 23 on the outer face thereof, a first clamping plate 26 having a low arcuate transverse ridge 27 interfitting with groove 25 and a lower edge 28 which is free from sharp corners, and a second clamping plate 31. A pair of transversely aligned fasteners 32 pass through plate 26 in the region of groove 25 and ridge 27, and are spaced by at least the width of strap 12, and a second pair of transversely aligned fasteners 33 pass through plate 31 and are also spaced by at least the width of the strap.

A pair of fasteners 29 are provided in tongue 23 below clamp 24, by means of which it is possible to removably secure to the tongue a winch 35 having a base plate 36, side plates 37 and 40, a hand crankshaft 41 with a pinion 42, a hand crank 43 and a gear 44 to which is secured a drive shaft 45 passing between the side walls. A releasable ratchet 46 coacts with pinion 42 to lock the windlass to any desired position of hand crank 43. A pair of discs 47 cooperate with shaft 45 to define the normal winding drum of the winch.

For use with a strap end 12 a drum of larger diameter than shaft 45 is desirable. I provide such a drum 50 made up of a pair of solid, semi-cylindrical bodies 51 and 52 jointly bored axially to define a passage for shaft 45 and having a pair of apposed flat surfaces 53 and 54. The flat surfaces may be drawn together by a pair of axially aligned fasteners 55 spaced by at least the width of strap 12. Member 52 is peripherally grooved to coact with a pin 56 in disc 46 to cause rotation of the drum when the disc rotates independently of shaft 45, on which members 51 and 52 need not be drivingly tight.

OPERATION

The use of my invention will now be explained. In building substructure 14, its dimensions are made to conform with those of the mobile home 10 to rest upon it, and gaps in sills 16 are provided in the known locations of straps 11, 12. Anchor plates 21 are positioned in the gaps, with tongues 23 angulated outwardly, and are secured to the slab 13 by fasteners 22. For greatest convenience, a pair of winches 35 are secured to the tongues 23 aligned with the ends 11, 12 of a single strap. Fasteners 32, 33 are loosened, and strap end 12, for example, is passed downwardly between groove 25 and ridge 27, thence around member 52 and into the space between surfaces 53 and 54, fasteners 55 then being tightened. Hand crank 43 is now operated to rotate drum 50 and tighten the strap, by drawing it through the clamp 24, the same prodecure being followed on the opposite side of the structure with strap end 11 to produce even strap loading. When the desired loading is accomplished, the winch positions are retained by ratchets 46 and fasteners 32 are tightened, clamping strap ends 11 and 12 between grooves 25 and 27 on opposite sides of the structure. When this is done, the ratchets may be released, the winches slacked off and removed, and the ends of the strap folded over and passed upwardly between plates 26 and 31, the fold or bend not being made sharp enough to overstress the strap. Now, when fasteners 33 are tightened, the strap end is held securely.

If only one winch is to be used, one end of the tape is positioned and clamped without winching, after which this end holds the strap while the other end is winched to the desired loading.

Note that the slight angulation of tongue 23 on anchor plate 21 brings the clamp 24 somewhat under the protection of the overlying vehicle, and also facilitates the application of sheathing material to studs 17.

Note also that other applications of my invention may arise where one end of a strap is secured to a first body in any desired fashion, and a tongue 23 is secured to the other body also in any desired fashion. The winching and clamping may then proceed to a secure anchoring together of the bodies as described above.

From the foregoing, it will be evident that I have invented a new and improved system and apparatus for anchoring mobile homes in place, or for other related purposes. The arrangement is convenient, simple, quick, and inexpensive, and by its use only one or preferably a pair of winches are needed regardless of the number of anchoring straps which are to be used.

Numerous characteristics and advantages of my invention have been set forth in the foregoing description, together with the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. The method of anchoring to the ground a structure having an anchor strap which comprises the steps of securing to the ground in line with said strap an anchor plate having an upstanding tongue with a stepped clamp at its upper end, temporarily securing a winch having a drum to said tongue below said clamp, feeding said strap through said clamp and clamping it to the drum of said winch, tightening the strap by use of the winch and clamping it to the first step of said clamp, releasing and removing the winch, and folding the strap on itself and securing the folded end to the second step of said clamp.

2. Apparatus for anchoring a structure to the ground, comprising, in combination:

an anchor plate secured to the ground and having an upstanding tongue with a stepped clamp at its upper end;

an anchor strap secured to the structure in line with said tongue;

a winch releasably secured to the tongue below the clamp and including a drum and means securing an end of said strap to said drum;

so that when the strap is passed through the clamp and secured to the drum, it may be tightened by winching, clamped, and released from the winch for further clamping.

3. The structure of claim 2 in which said tongue makes an angle of about 86° with said anchor plate.

4. The structure of claim 2 in which said anchor strap passes over said structure and a pair of said anchor plates are positioned in line with the two ends of the strap.

5. The structure of claim 2 in which said stepped clamp comprises a shallow, generally arcuate transverse groove in said tongue, a transverse clamping plate having a low generally arcuate transverse ridge mating with said groove and a lower edge free from sharp corners, a first pair of transversely aligned fasteners spaced apart by at least the width of said strap and passing through said plate in the area of said groove and said ridge, a second transverse clamping plate, and a second pair of transversely aligned fasteners spaced apart by at least the width of said strap and passing through said plates at locations displaced from said groove and ridge.

6. The structure of claim 2 in which said drum of said winch comprises a pair of solid semi-cylindrical members jointly apertured to pass the driving shaft of the winch and having a pair of opposable flat surfaces, fastener means for drawing said flat surfaces toward one another and spaced in the axial direction by at least the width of the strap, and means independent of said drive shaft for causing rotation of said drum.

7. Apparatus for anchoring a structure to the ground, comprising, in combination:

an anchor plate secured to the ground and having an upstanding tongue with a stepped clamp at its upper ends, said stepped clamp comprising a shallow arcuate transverse groove across said tongue, a first clamping plate including a low arcuate transverse ridge interfitting with said groove, a second clamping plate engaging said first clamping plate, and means securing said clamping plate to said tongue;

an anchor strap secured to the structure in line with said tongue;

a winch releasably secured to the tongue below the clamp and including a drum and means securing an end of said strap to said drum;

so that when the strap is passed through the clamp and secured to the drum, it may be tightened by winching, clamped, and released from the winch for further clamping.

* * * * *